US010037842B2

(12) United States Patent
Kim et al.

(10) Patent No.: US 10,037,842 B2
(45) Date of Patent: Jul. 31, 2018

(54) MOLDING INDUCTOR

(71) Applicant: Hyundai Motor Company, Seoul (KR)

(72) Inventors: Hyungsuk Kim, Whasung-Si (KR); Jeong Hyeon Kim, Whasung-Si (KR); Bong Gi Yu, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 33 days.

(21) Appl. No.: 15/270,260

(22) Filed: Sep. 20, 2016

(65) Prior Publication Data

US 2018/0012695 A1 Jan. 11, 2018

(30) Foreign Application Priority Data

Jul. 7, 2016 (KR) ..... 10-2016-0086220

(51) Int. Cl.

| | |
|---|---|
| ***H01F 27/30*** | (2006.01) |
| ***H01F 27/255*** | (2006.01) |
| ***H01F 27/32*** | (2006.01) |
| ***H01F 27/29*** | (2006.01) |
| ***H01F 27/08*** | (2006.01) |
| ***H01F 27/02*** | (2006.01) |

(52) U.S. Cl.

CPC ..... *H01F 27/255* (2013.01); *H01F 27/02* (2013.01); *H01F 27/085* (2013.01); *H01F 27/29* (2013.01); *H01F 27/30* (2013.01); *H01F 27/325* (2013.01)

(58) Field of Classification Search

CPC ..... H01F 27/00–27/36; H01F 5/00
USPC ..... 336/65, 83, 90, 196, 198, 200
See application file for complete search history.

(56) References Cited

FOREIGN PATENT DOCUMENTS

| | | | |
|---|---|---|---|
| JP | 2005-012005 | A | 1/2005 |
| JP | 2012-119415 | | 6/2012 |
| KR | 10-2006-0116235 | A | 11/2006 |
| KR | 10-2010-0119641 | A | 11/2010 |
| KR | 10-2014-0131418 | A | 11/2014 |
| KR | 1020140128069 | | 11/2014 |

*Primary Examiner* — Tuyen Nguyen
(74) *Attorney, Agent, or Firm* — Morgan, Lewis & Bockius LLP

(57) ABSTRACT

A molding inductor may include a bus-bar having a core hole thereon, and formed of copper material, a bobbin covering the bus-bar to insulate the bus-bar from an exterior, a cylinder core comprising a soft magnetic material, and inserted into the core hole, and an inductor case receiving the bobbin at an exterior of the bobbin.

10 Claims, 6 Drawing Sheets

MOLDING INDUCTOR

CROSS-REFERENCE TO RELATED APPLICATION

The present application claims priority to Korean Patent Application No. 10-2016-0086220, filed Jul. 7, 2016, the entire contents of which is incorporated herein for all purposes by this reference.

BACKGROUND OF THE INVENTION

Field of the Invention

The present invention relates to a molding inductor. More particularly, the present invention relates to a molding inductor in which a soft magnetic core is inserted so as to increase performance of the magnetic permeability and to withstand voltage.

Description of Related Art

In general, an inductor for a vehicle may be classified into a ferrite core type, a soft magnetic powder type, a winding core reclamation type, and a molding inductor type according to a shape of core which is provided therein.

The ferrite core type may use a soft magnetic ferrite wound by the copper wire as an inductor. The soft magnetic ferrite is made by sintering the oxidized steel which is compressed in the mold. The ferrite has very high magnetic permeability and is saturated under low current. Accordingly, the ferrite has a characteristics not conducive to use under high current states. Thus, in the ferrite core type, the inductor has an air gap which is formed above 0.2 mm below 4 mm in a radial direction to increase a direct current (DC) overlapping characteristic. Therefore, it may prevent saturation of the inductor under high current state.

This inductor in the ferrite core type is fastened by the clamp. In other words, the ferrite is fixed on the circuit by the clamp and is pressed from an upward direction downward. However, the ferrite in which air gap is inserted may be damaged by the pressure of clamp or vibration of vehicle. In addition, the heat generated from ferrite core may not be exhausted by the air gap.

A soft magnetic powder type inductor core is made by filling a soft magnetic powder into the mold and applying pressure by pressing, and winding wire on the outside thereof. However, this soft magnetic powder type has higher current loss than the ferrite core type due to the material characteristics thereof.

A winding core reclamation type inductor core is made through a method of fixing a copper wire inside of the mold and filling soft magnetic powder thereto, and applying pressure by the pressing. According to above method, the heat treatment should be needed in order to release the stress of the powder. By the way, in the heat treatment process, the insulation coating portion of the copper wire may be damaged.

When the heat treatment temperature is not high enough in the heat treatment process for preserving the insulation coating portion, the stress applied in to the powder remains as it is and the core loss is increased.

Lastly, the inductor core of the molding inductor type is manufactured as below. In advance, the soft magnetic powder and the binder are mixed and the mixture is inserted into the case. And after, the case is heated. In other words, after the copper wire is fixed inside of the inductor case, the soft magnetic powder and the binder (e.g., epoxy) are injected therein. After that, heating over 120 degrees, the epoxy, which is a thermosetting resin, is harden and complete the inductor.

This molding inductor type has merits in that the inductor may be down-sized and weight lightened. However, the amount of magnetic materials are smaller than the other types because the molding inductor type should mix the soft magnetic powder and the binder. Therefore, the magnetic permeability may be relatively decreased.

Meanwhile, in recent the molding inductor of the Surface Mounted Device (SMD) has been researched. This molding inductor, in a shape of SMD, has a copper wire in the magnetic material. Accordingly the size may be decreased. Therefore, the molding inductor of the SMD type tends to be applied to many home appliances such as mobile phones and televisions, which have the existing pin type inductor.

However, the molding inductor of SMD type is only used in low current appliances and it is difficult to apply to appliances with high current, for example power converter of environmentally-friendly vehicle flowing over the 100 Amperes (A) current. Because, there is no copper wire for insulation coating which can bear over 100 A current. Therefore, if the molding inductor according to the conventional art is applied into the power converter, then the inductor may break down.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a molding inductor having advantages of fixing a bus-bar and cylinder core at a predetermined position. In particular, a molding inductor provided with a soft magnetic core having high magnetic permeability therein, accordingly, the magnetic permeability is improved. In addition, by applying a bobbin, position of the cylinder core is easily determined and the bus-bar is insulated. Therefore the molding inductor may be used under high current state.

According to various aspects of the present invention, a molding inductor may include a bus-bar having a core hole thereon, and formed of copper material, a bobbin covering the bus-bar to insulate the bus-bar from an exterior, a cylinder core comprising a soft magnetic material, and inserted into the core hole, and an inductor case receiving the bobbin at an exterior of the bobbin.

The bus-bar may be wound in a coil shape from a first terminal to a second terminal thereof in a clockwise direction.

The bobbin may include an upper bobbin covering an upper portion of the bus-bar and upper sides of the first and the second terminals, and a lower bobbin covering a lower portion of the bus-bar and lower sides of the first and the second terminals, and the upper bobbin and the lower bobbin may be combined with each other and configured to cover an exterior of the bus-bar to insulate the bus-bar from the exterior.

The upper bobbin and the lower bobbin may face each other in upward and down directions and may be symmetrically disposed with respect to each other.

An upper bobbin extension portion protrudes downward from the upper bobbin and may be formed in a corresponding shape of the core hole for insertion into the core hole, and a lower bobbin extension portion may protrude upward from the lower bobbin and may be inserted into the core hole to cut inside of the core hole from the exterior.

The upper bobbin may include a first upper duct extended along the first terminal and open downward, and a second upper duct extended along the second terminal in a state of being spaced from the first upper duct in a width direction and open downward, in which the lower bobbin may include a first lower duct extended along the first terminal and open upward, and a second lower duct extended along the second terminal and open upward, and the first upper duct and the first lower duct may be combined to form a first passage, and the second upper duct and the second lower duct may be combined to form a second passage with each other, respectively, in the upward and down directions.

In a state that the bobbin with the bus-bar is fixed to the inductor case, a mixture of powder and binder may be injected between the inductor case and the bobbin and may be treated by heating.

At least one fixing portion may be provided at a portion in which an inside of the inductor case is bent, and the fixing portion may be formed in an L-shape and configured to fix a portion in which the exterior of the bobbin is bent.

In a state that the bobbin is fixed to the inductor case, the cylinder core is inserted and fixed to the core hole to adjust position of the cylinder core into a home position.

An exterior circumference of the cylinder core and interior circumferences of the upper and the lower bobbin extension portions are formed in shapes corresponding to each other.

The cylinder core may be a compressed powder core to increase magnetic permeability.

The cylinder core may be a silicon steel plate core or a ferrite core.

The molding inductor may further include a radiation plate provided with a mounting groove formed along an edge thereof and combined with a lower end of the inductor case, and a fixing plate having three protrusions formed thereon, and inserted into and disposed in a plate receiving groove formed on the radiation plate.

The radiation plate may be aluminum to give off heat in the inductor case to an exterior.

Bolt fastening portions may be formed at both sides of the radiation plate and extended to both sides, and the bolt fastening portions may have bolt fastening holes for installation of a circuit board thereto.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
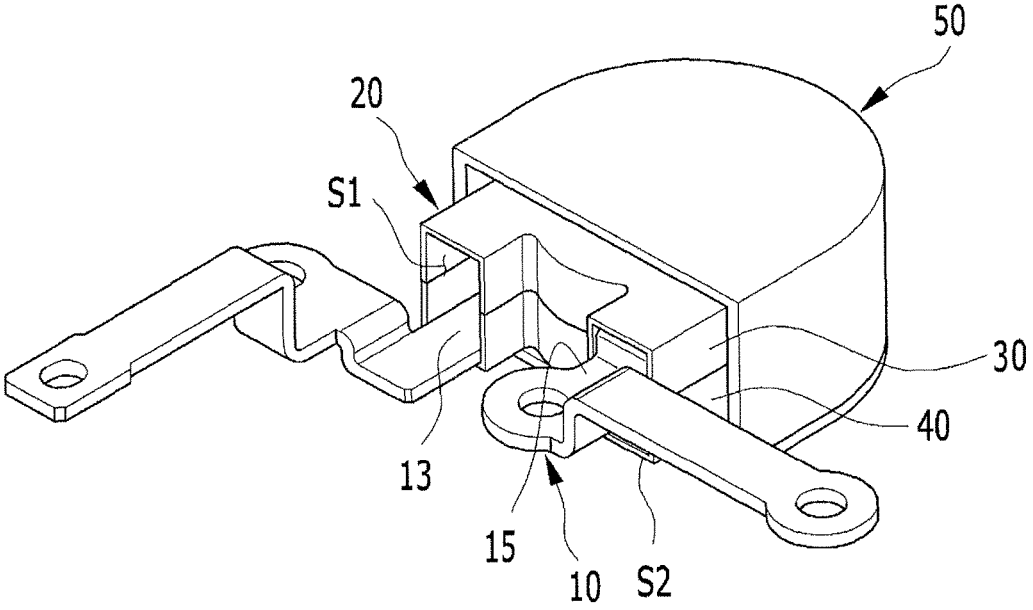
FIG. 1 is a perspective view of a molding inductor according to various embodiments of the present invention.
Figure 2:
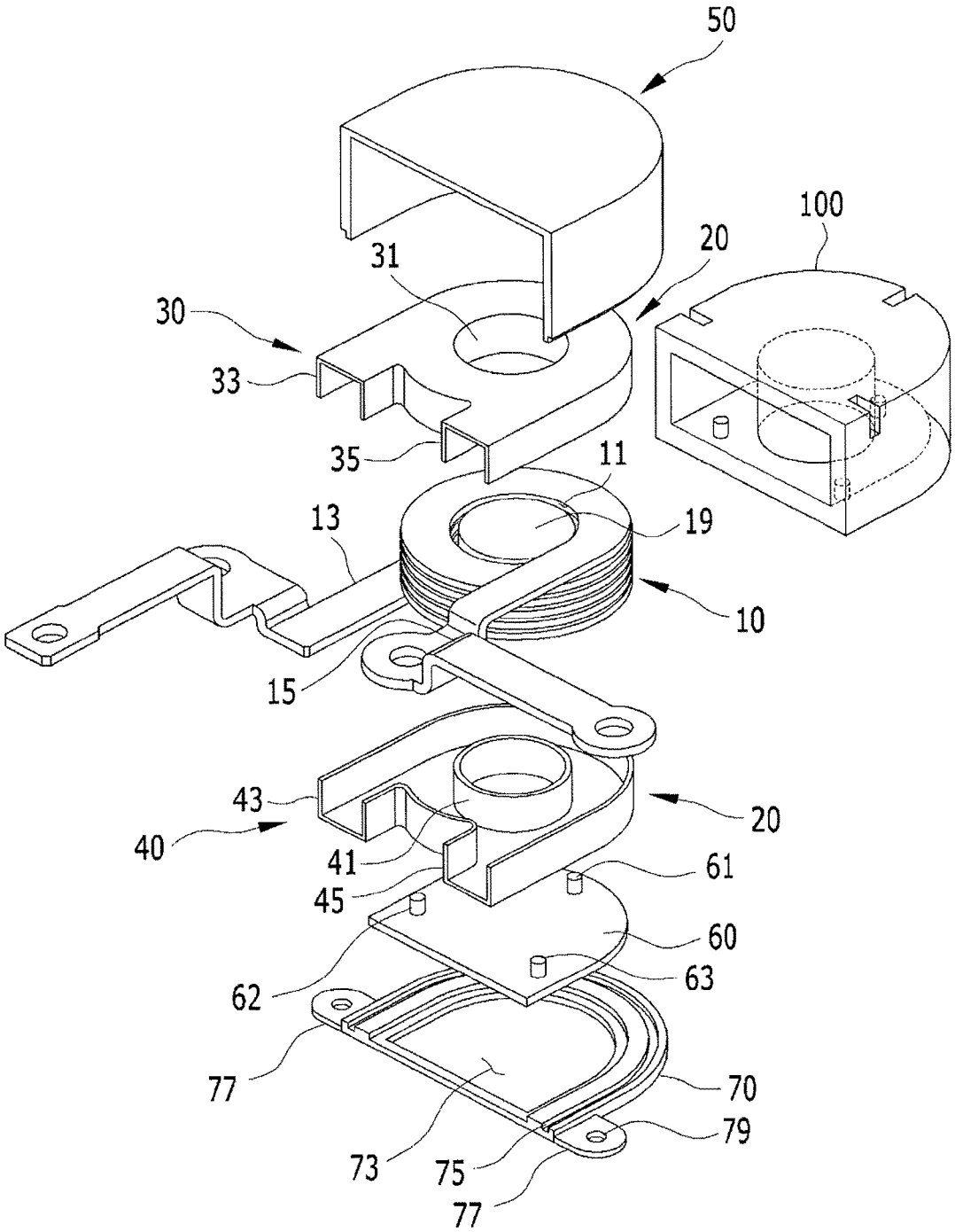
FIG. 2 is an exploded perspective view of a molding inductor according to various embodiments of the present invention.
Figure 3:
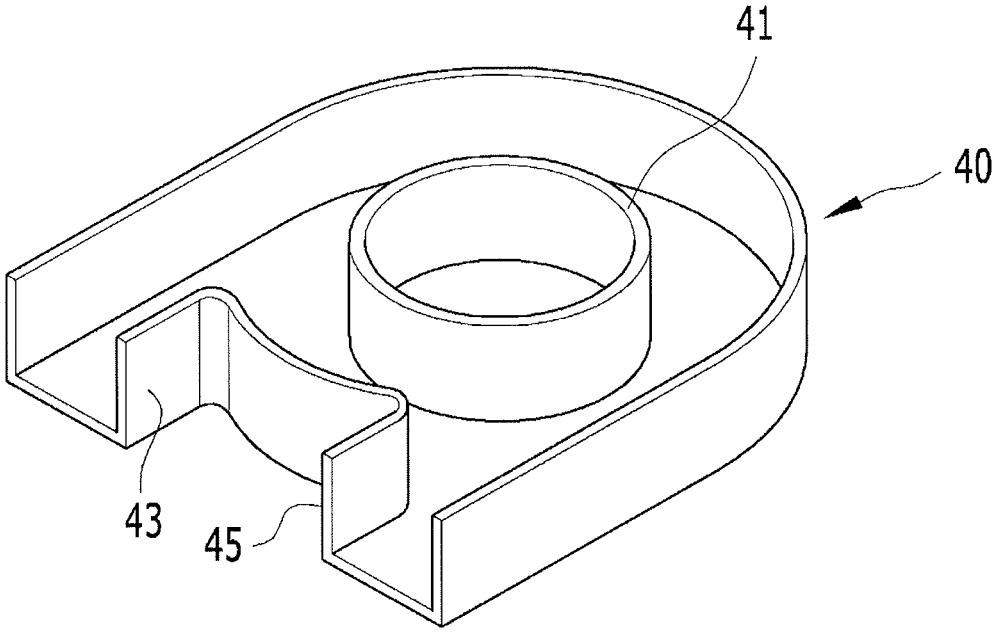
FIG. 3 is a perspective view of lower bobbin of molding inductor according to various embodiments of the present invention.
Figure 4:
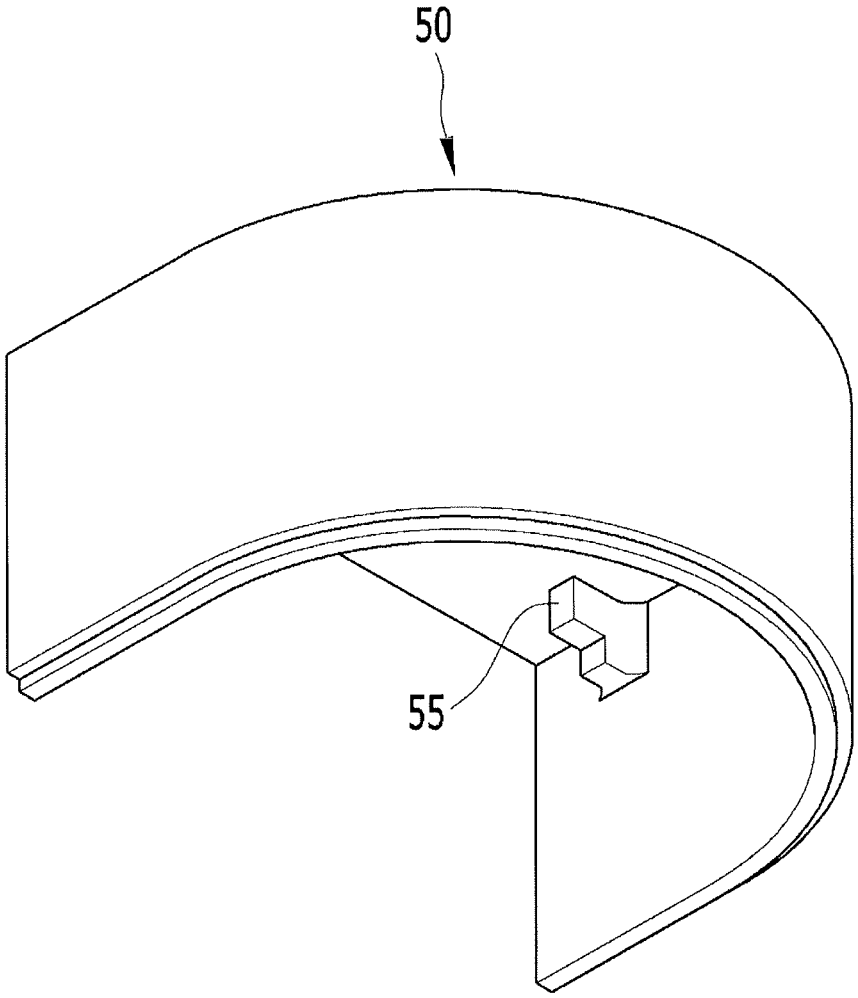
FIG. 4 is a perspective view of inductor case of a molding inductor according to various embodiments of the present invention.
Figure 5:
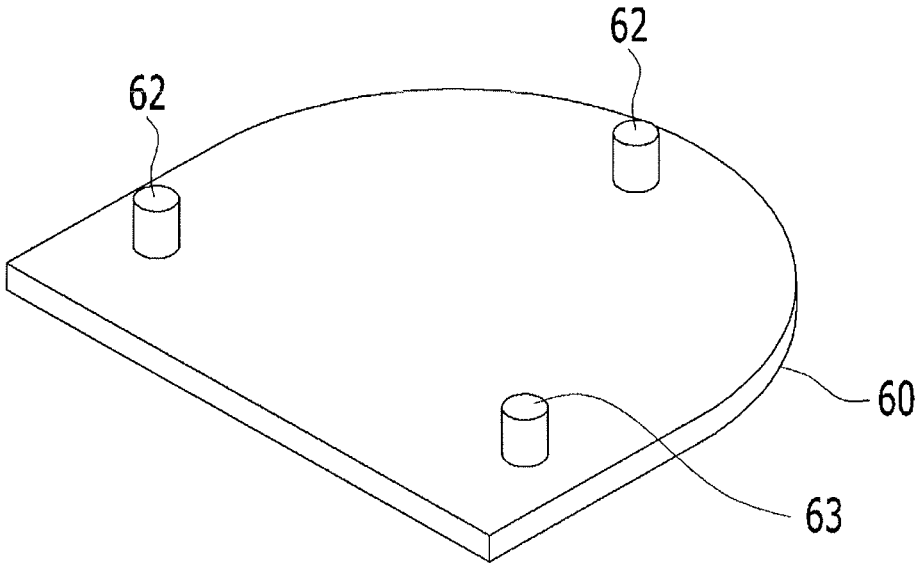
FIG. 5 is a perspective view of fixing plate of molding inductor according to various embodiments of the present invention.
Figure 6:
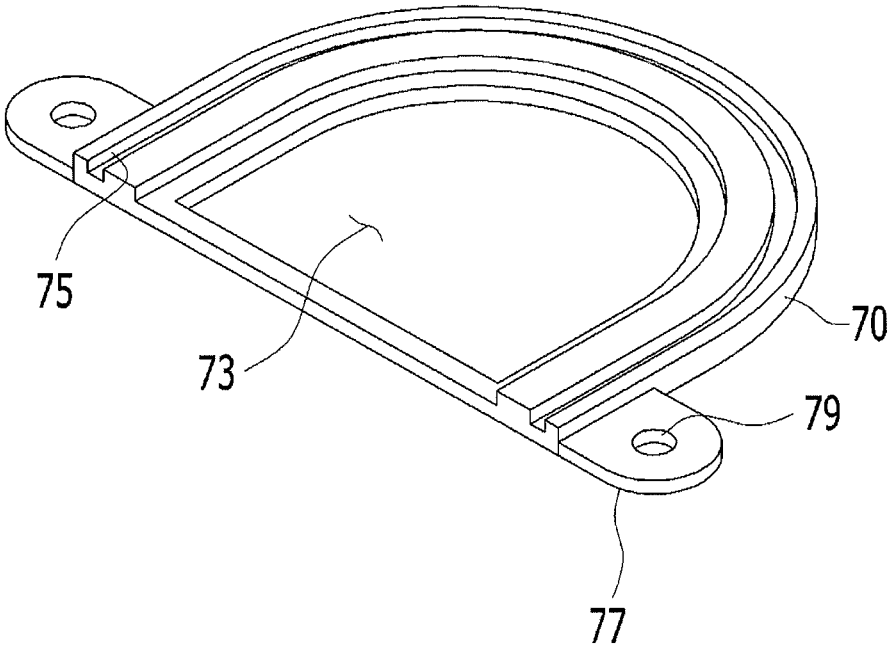
FIG. 6 is a perspective view of a radiation plate of molding inductor according to various embodiments of the present invention.

FIG. 1 is a perspective view of a molding inductor according to various embodiments of the present invention, FIG. 2 is an exploded perspective view of a molding inductor according to various embodiments of the present invention, FIG. 3 is a perspective view of lower bobbin of molding inductor according to various embodiments of the present invention, FIG. 4 is a perspective view of inductor case of a molding inductor according to various embodiments of the present invention, FIG. 5 is a perspective view of fixing plate of molding inductor according to various embodiments of the present invention, and FIG. 6 is a perspective view of a radiation plate of molding inductor according to various embodiments of the present invention.

The molding inductor illustrated in FIGS. 1 to 6 shows one example of various structures of molding inductors, and the spirit of the various embodiments of the present invention is not restrictively applied to the molding inductor described in the specification but may be applied to various molding inductors.

According to various embodiments, a molding inductor includes a bus-bar 10, a bobbin 20 which covers the bus-bar 10, and an inductor case 50 which disposed at an exterior of the bobbin 20 and fixes the bobbin 20.

The bus-bar 10 may be formed with copper and has a first terminal 13 and a second terminal 15 is extended in one side thereof. The bus-bar 10 is wound in a coil shape from the first terminal 13 to the second terminal 15 in a clockwise direction. At this point, the bus-bar 10 is wound in a cylinder shape from the first terminal 13 to the second terminal 15 and the cylinder may be formed to be open in the vertical direction so as to form a core hole 11. The coil hole 11 is formed cylindrically and magnetic material which has high magnetic permeability is inserted therein. Thus, the entire magnetic permeability of the molding inductor may be increased. Therefore, the entire length of the bus-bar 10 which is wound in a coil shape may be minimized. Moreover, turn number of the coil of the bus-bar 10 may be decreased, resistance of copper line may be decreased too.

A soft magnetic cylinder core 19 may be inserted into the core hole 11.

The cylinder core 19 may be a compressed powder core, silicon steel plate core, or ferrite core, accordingly, the magnetic permeability of the cylinder core 19 may be improved.

According to various embodiments, a bobbin 20 includes an upper bobbin 30 which covers the upper side of the bus-bar 10 and a lower bobbin 40 which covers the lower side of the bus-bar 10. The upper bobbin 30 and the lower bobbin 40 are combined in a upper and lower direction and insulates the bus-bar 10 from outside thereof. In other words, the bus-bar 10 is cut off from the outside by the bobbin 20, even if the mixture of the soft magnetic powder and binder flows in the inductor case 50 and is hardened, the bus-bar 10 is not connected with the mixture.

Therefore, electrical insulation between the bus-bar 10 and the magnetic material is possible and the copper material which endures under a high current state may be used for the bus-bar 10. As a result, the bus-bar 10 may receive high current therein without damage although the bus-bar 10 does not have an insulation coating, due to insulation by the bobbin 20. For example, high current over 100 A which is used in the environmentally-friendly vehicle may be available. In addition, the bus-bar 10 according to various embodiments of the present invention may have the insulation coating. And the damage of the insulation coating of bus-bar 10 could be avoided owing to skipping the process of heat treatment on the mixture of the soft magnetic powder and binder with high temperature.

The upper bobbin 30 has an upper bobbin extension portion 31 which is inserted into the core hole 11 of the bus-bar 10 and the lower bobbin 40 has a lower bobbin extension portion 41 which is inserted into the core hole 11 and protruded upward. The upper bobbin extension portion 31 and lower bobbin extension portion 41 are disposed to correspond to each other and are extended in an upward and downward along inner surface of the core hole 11. The upper and lower bobbin extension portion 31 and 41 may determine the position of the cylinder core 19. That is, the upper and lower bobbin extension portion 31 and 41 are disposed on an inner surface of the core hole 11 with positioning the center of the cylinder core 19 at a home position.

Also, the upper bobbin 30 has a first upper duct 33 and a second upper duct 35. The first upper duct 33 is extended one direction along with the first terminal 13 with top closed and bottom open, and the second upper duct 35 is extended along with the second terminal 15 in one direction and is spaced from the first upper duct 33 in a width direction.

Corresponding to the upper bobbin 30, the lower bobbin 40 has a first lower duct 43 which is expended along with the first terminal 13 and is opened upward and a second lower duct 45 which is extended along with the second terminal 15 and is opened upward.

The first upper duct 33 and the first lower duct 43, and the second upper duct 35 and the second lower duct 45 are combined with each other in a upward and downward direction and may form first and second passages S1 and S2 respectively. The first terminal 13 is positioned at the first passage S1 and the second terminal 15 is positioned at the second passage S2.

As described above, the upper bobbin 30 and the lower bobbin 40 are disposed in an up and down directions and face each other. As shown in the FIG. 3, the upper bobbin 30 is symmetrically disposed at the upper side of the lower bobbin 40. And furthermore, a side surface of the lower bobbin 40, the first and second lower ducts 43 and 45, and the lower bobbin extension portion 41 correspond with a side surface of the upper bobbin 30, the first and second ducts 33 and 35, and the upper bobbin extension portion 31. Therefore, the bus-bar 10 which is disposed inside of the upper bobbin 30 and lower bobbin 40 may be insulated from the exterior. At this time, by manufacturing the upper and lower bobbins 30 and 40 as a same shape, the productivity will be increased.

The inductor case 50 is disposed exterior of the bobbin 20 and is adapted to fasten the position of the bobbin 20. In other words, as shown in FIG. 4, inductor case 50 has a fixing portion 55 which fixes the bobbin 20 while the mixture of the soft magnetic powder flows in.

At least one fixing portion 55 may be provided at bent position between the upper surface and the side surface of the inductor case 50. In addition, the fixing portion 55 may be formed bent in an L-shape and is adapted to fasten at bent portion of the upper bobbin 30 so as to fix the upper bobbin 30.

Meanwhile, if the cylinder core 19 is slanted to one side, then the inductance of the inductor is not distributed properly and the inductor which is not met the required performance may be produced. However, according to various embodiments of the present invention, the mixture of the powder and the binder flows in between the inductor case 50 and the bobbin 20 while the bobbin 20 is fastened to the inductor case 50, and the heat treatment is processed. At this time, the position of the cylinder core 19 including the compressed powder core is held at the home position at all times by the bobbin 20. The bobbin 20 according to the present invention may prevent the cylinder core 19 from being slanted to one side and put the center of the cylinder core 19 on the center of the core hole 11. For this, the exterior circumference of the cylinder core 19 and interior circumferences of the upper and lower bobbin extension portions 31 and 41 are formed in shape corresponding with each other.

The molding inductor according to various embodiments of the present invention may further include a radiation plate 70 to emit heat generated inside of the inductor. The radiation plate 70 may be formed of material with a light weight and high heat dissipation so as to emit the heat generated from the inductor into the circuit board which is contacted with the inductor. For example, the radiation plate 70 may be made of an aluminum material.

The radiation plate 70 has a mounting groove 75 which is formed along an edge thereof. The mounting groove 75 is combined with the inductor case 50 whose lower end is inserted into the mounting groove 75. And a plate receiving groove 73 is formed at the radiation plate 70 in order to seat a fixing plate 60.

A bolt fastening portion 77 are formed at both side of the radiation plate 70 and are extended both side thereof. And a bolt fastening hole 79 is formed such that the circuit board is possible to be installed. Therefore, the inductor may be installed to the circuit board by bolt fastening.

The fixing plate 60 has three protrusions 61, 62, and 63 there on and inserted to the plate receiving groove 73 formed at the radiation plate 70 to be installed. As the fixing plate 60 is inserted into the radiation plate 70, accordingly, the stiffness of the radiation plate 70 is increased and the lower portion of the inductor is well supported simultaneously. The three protrusions 61, 62, and 63 are formed at a predetermined position to meet requirement of the performance of the inductor.

The fixing plate 60 and the radiation plate 70 may be fixed by such an adhesive.

Thereby, the molding inductor according various embodiments of the present invention may insulate and fix the bus-bar 10 by the bobbin 20, and the bus-bar 10 is covered by the inductor case 50, fixing plate 60, and the radiation plate 70. In addition, as soft magnetic powder mixture is input into the inside of the inductor case 50 and the heat or pressure is applied therein, the magnetic material 100 is hardened and the molding inductor is simultaneously completed.

The molding inductor of the various embodiments of the present invention has a soft magnetic core inserted therein, accordingly, the magnetic permeability may be improved. Meanwhile, the molding inductor is provided with the bobbin 20 and the bobbin 20 may fix the bus-bar 10 at predetermined position in a process of manufacturing the molding inductor. Simultaneously, the position of the cylinder core 18 may be fixed by the bobbin 20. Therefore, the cylinder core 19 may be fixed at a certain position, and the molding inductor may keep stable performance.

In the molding inductor according to various embodiments of the present invention, the soft magnetic core is inserted therein and the magnetic permeability is improved. In addition, due to the molding inductor provided with the bobbin, it is possible to insulate between the bus-bar and magnetic material. Thereby, the molding inductor may be used under high voltage.

Further, by the bobbin, the bus-bar is fixed at a predetermined position, and the cylinder core is fixed simultaneously. Therefore, even if the soft magnetic core is inserted into the magnetic material, the bus-bar and cylinder core are not slanted one direction and fastened at the core hole.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A molding inductor, comprising:

a bus-bar having a core hole thereon, and formed of copper material;

a bobbin covering the bus-bar to insulate the bus-bar from an exterior;

a cylinder core comprising a soft magnetic material, and inserted into the core hole; and an inductor case receiving the bobbin at an exterior of the bobbin, wherein the bus-bar is wound in a coil shape from a first terminal to a second terminal thereof in a clockwise direction, wherein the bobbin comprises:

an upper bobbin covering an upper portion of the bus-bar and upper sides of the first and the second terminals; and a lower bobbin covering a lower portion of the bus-bar and lower sides of the first and the second terminals, and wherein the upper bobbin and the lower bobbin are combined with each other and configured to cover an exterior of the bus-bar to insulate the bus-bar from the exterior, wherein the upper bobbin and the lower bobbin face each other in upward and down directions and are symmetrically disposed with respect to each other, wherein an upper bobbin extension portion protrudes downward from the upper bobbin and is formed in a corresponding shape of the core hole for insertion into the core hole, and wherein a lower bobbin extension portion protrudes upward from the lower bobbin and is inserted into the core hole to cut inside of the core hole from the exterior, wherein the upper bobbin comprises:

a first upper duct extended along the first terminal and open downward; and a second upper duct extended along the second terminal in a state of being spaced from the first upper duct in a width direction and open downward, wherein the lower bobbin comprises:

a first lower duct extended along the first terminal and open upward; and a second lower duct extended along the second terminal and open upward, and wherein the first upper duct and the first lower duct are combined to form a first passage, and the second upper duct and the second lower duct are combined to form a second passage with each other, respectively, in the upward and down directions.

2. The molding inductor of claim 1, wherein, in a state that the bobbin with the bus-bar is fixed to the inductor case, a mixture of powder and binder is injected between the inductor case and the bobbin and is treated by heating.

3. The molding inductor of claim 2, wherein at least one fixing portion is provided at a portion in which an inside of the inductor case is bent, and the fixing portion is formed in an L-shape and configured to fix a portion in which the exterior of the bobbin is bent.

4. The molding inductor of claim 3, wherein in a state that the bobbin is fixed to the inductor case, the cylinder core is inserted and fixed to the core hole to adjust position of the cylinder core into a home position.

5. The molding inductor of claim 4, wherein an exterior circumference of the cylinder core and interior circumferences of the upper and the lower bobbin extension portions are formed in shapes corresponding to each other.

6. The molding inductor of claim 5, wherein the cylinder core comprises a compressed powder core to increase magnetic permeability.

7. The molding inductor of claim 6, wherein the cylinder core comprises a silicon steel plate core or a ferrite core.

8. The molding inductor of claim 7, further comprising:

a radiation plate provided with a mounting groove formed along an edge thereof and combined with a lower end of the inductor case; and a fixing plate having three protrusions formed thereon, and inserted into and disposed in a plate receiving groove formed on the radiation plate.

9. The molding inductor of claim 8, wherein the radiation plate comprises aluminum to give off heat in the inductor case to an exterior.

10. The molding inductor of claim 9, wherein bolt fastening portions are formed at both sides of the radiation plate and extended to both sides, and the bolt fastening portions have bolt fastening holes for installation of a circuit board thereto.

* * * * *